US005367720A

United States Patent [19]

Stephens et al.

[11] Patent Number: 5,367,720

[45] Date of Patent: Nov. 29, 1994

[54] FOOT WASHER APPARATUS

[76] Inventors: Beery W. Stephens; Carey S. Stephens, both of 3917 Rive Gauche, Las Vegas, Nev. 89115

[21] Appl. No.: 814,589

[22] Filed: Dec. 30, 1991

[51] Int. Cl.[5] ..... A47K 3/022

[52] U.S. Cl. ..... 4/494; 4/615

[58] Field of Search ..... 4/494, 496, 569, 570, 4/591, 601, 615, 616, 622

[56] References Cited

U.S. PATENT DOCUMENTS

| | | | |
|---|---|---|---|
| 1,083,141 | 12/1913 | Rock | 4/570 |
| 2,654,894 | 10/1953 | Van Dijck | 4/615 |
| 2,702,390 | 2/1955 | Dillon | 4/601 |
| 3,895,398 | 7/1975 | Mustee | 4/613 |
| 3,925,830 | 12/1975 | Delaney | 4/615 |
| 3,973,286 | 8/1976 | Logan | 4/615 X |

FOREIGN PATENT DOCUMENTS

| | | | |
|---|---|---|---|
| 0005709 | 3/1916 | United Kingdom | 4/591 |

*Primary Examiner*—Henry J. Recla
*Assistant Examiner*—Robert M. Fetsuga
*Attorney, Agent, or Firm*—Hugh E. Smith

[57] ABSTRACT

An apparatus including a container to include side walls and a floor, with a drain directed through the floor to a drainage conduit, with a fluid conduit directed into a fluid manifold, wherein the fluid manifold is mounted to the container, with apertures projecting into the container to permit washing of an individual's feet positioned within the container. A valve structure is provided to effect actuation of water through the fluid conduit to be utilized as a manually manipulatable valve, or as a lever arranged to displace a piston within a valve housing permitting fluid flow into the manifold.

2 Claims, 6 Drawing Sheets

FOOT WASHER APPARATUS

FIELD OF THE INVENTION

The field of invention relates to swimming pool apparatus, and more particularly pertains to a new and improved foot washer apparatus wherein the same is arranged to be used in conjunction with a swimming pool to effect washing of an individual's feet prior to use of the swimming pool structure.

DESCRIPTION OF THE PRIOR ART

Various foot bath structure for use in conjunction with swimming pools has been set forth in the prior art to accommodate the removal of excess debris from an individual's feet prior to use of a swimming pool to minimize clogging of filtration systems and the like utilized relative to a swimming pool and prevent unnecessary accelerated degradation of water utilized within the swimming pool structure. Such a bath structure is set forth in the U.S. Pat. No. 4,086,669 to Combis setting forth a foot bath arrangement to include a bath structure having water directed thereto through a chemical container structure.

U.S. Pat. No. 4,057,053 to Kunz sets forth a foot bath in connection with a massage structure for the massaging and bathing of a foot.

U.S. Pat. Nos. 4,497,313 to Kurosaqa and 4,620,529 to Kurosawa are further examples of foot bath structure utilizing vibrator massagers in association with a foot bath.

As such, it may be appreciated that there continues to be a need for a new and improved foot washer apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of foot bathing apparatus now present in the prior art, the present invention provides a foot washer apparatus wherein the same is arranged to direct a spray of water onto an individual's feet positioned within a housing of the foot bath structure. As such, the general purpose of the present invention, which will be described subsequently in greater detail, is to provide a new and improved foot washer apparatus which has all the advantages of the prior art foot bathing apparatus and none of the disadvantages.

To attain this, the present invention provides an apparatus including a container to include side walls and a floor, with a drain directed through the floor to a drainage conduit, with a fluid conduit directed into a fluid manifold, wherein the fluid manifold is mounted to the container, with apertures projecting into the container to permit washing of an individual's feet positioned within the container. A valve structure is provided to effect actuation of water through the fluid conduit to be utilized as a manually manipulatable valve, or as a lever arranged to displace a piston within a valve housing permitting fluid flow into the manifold.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will from the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foot washer apparatus which has all the advantages of the prior art foot bathing apparatus and none of the disadvantages.

It is another object of the present invention to provide a new and improved foot washer apparatus which may be easily and efficiently manufactured and marketed.

It is a further object of the present invention to provide a new and improved foot washer apparatus which is of a durable and reliable construction.

An even further object of the present invention is to provide a new and improved foot washer apparatus which is susceptible of a low cost of manufacture with regard to both materials and labor, and which accordingly is then susceptible of low prices of sale to the consuming public, thereby making such foot washer apparatus economically available to the buying public.

Still yet another object of the present invention is to provide a new and improved foot washer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
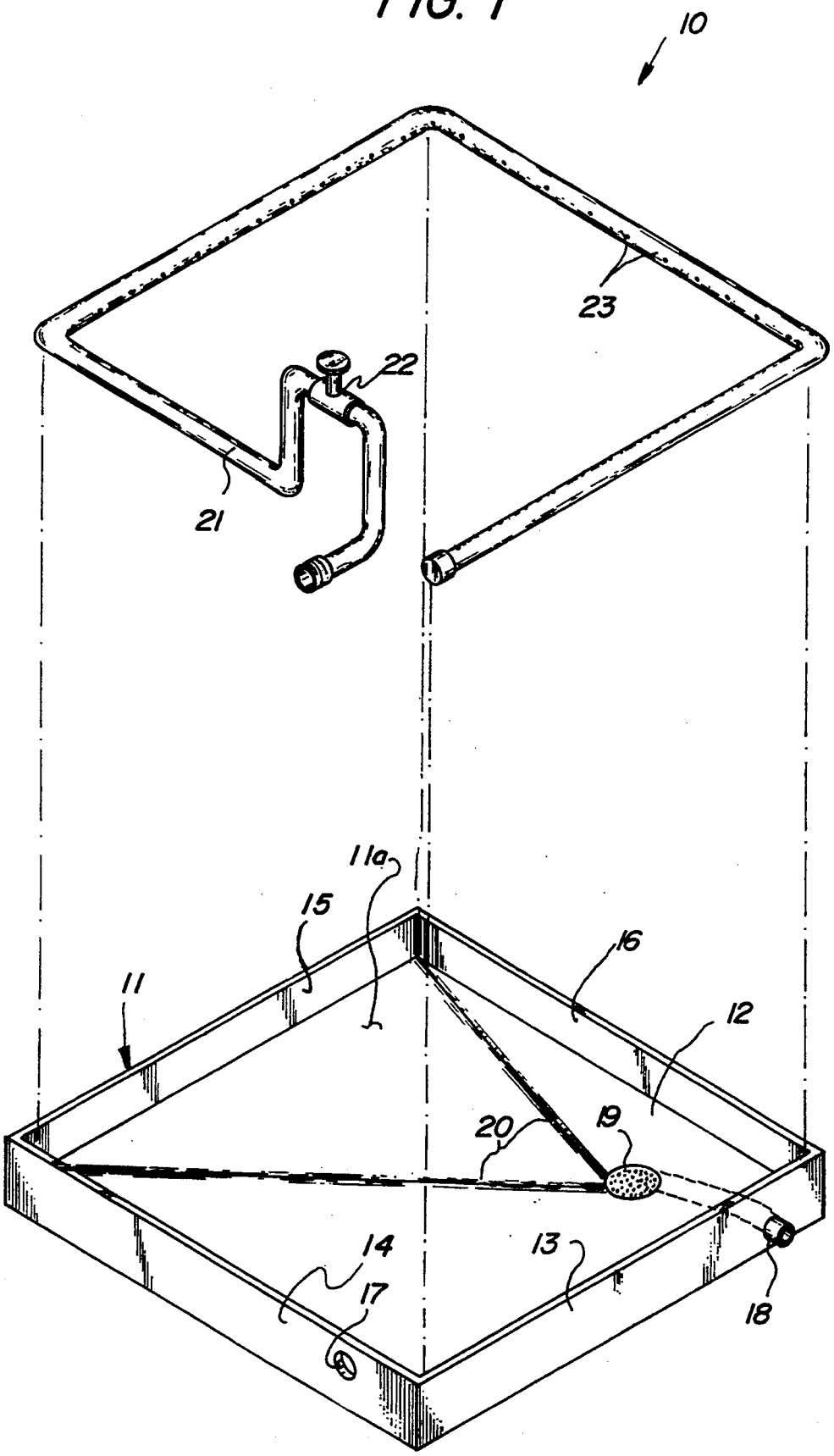
FIG. 1 is an isometric illustration of the instant invention in an exploded illustration.
Figure 2:
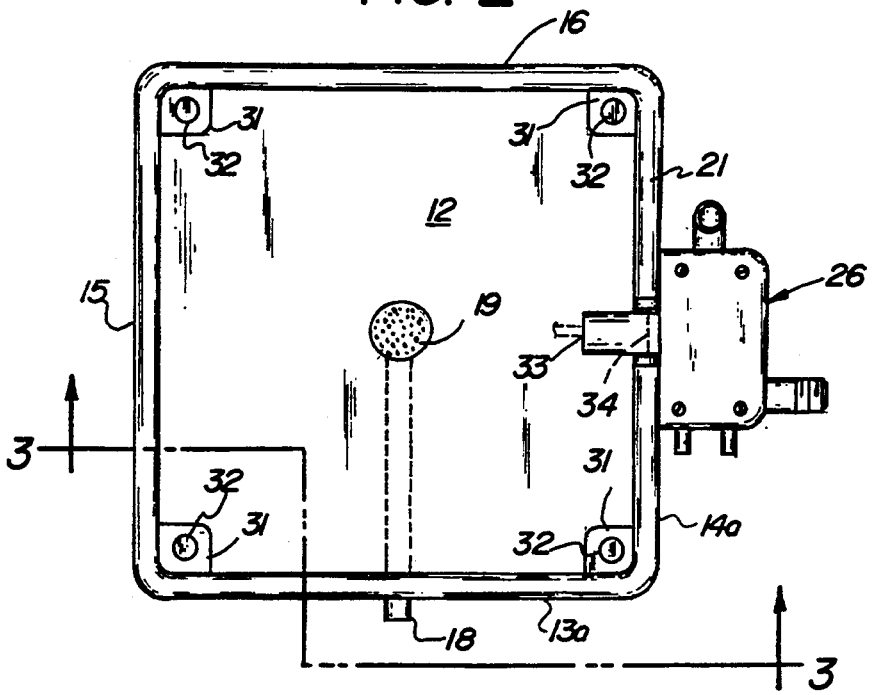
FIG. 2 is an orthographic top view of a modified housing utilized setting forth a modified foot washer apparatus of the invention.
Figure 3:
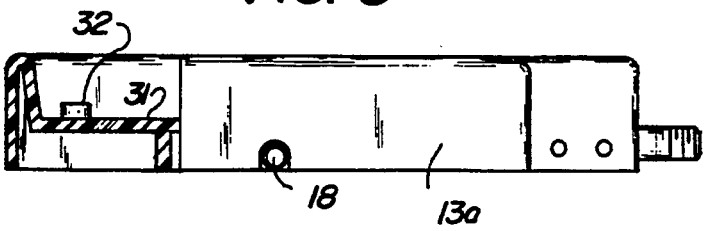
FIG. 3 is an orthographic view, taken along the lines 3–3 of FIG. 2 in the direction indicated by the arrows.
Figure 4:
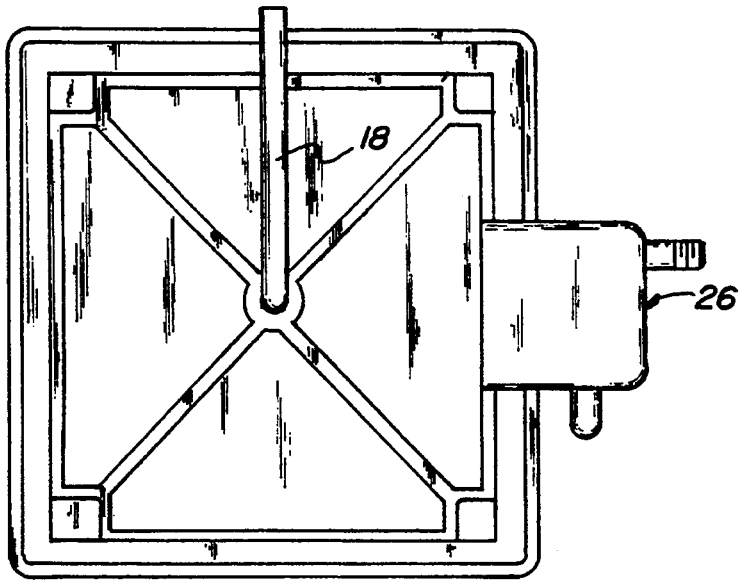
FIG. 4 is an orthographic bottom view of the housing, as set forth in FIG. 2.
Figure 5:
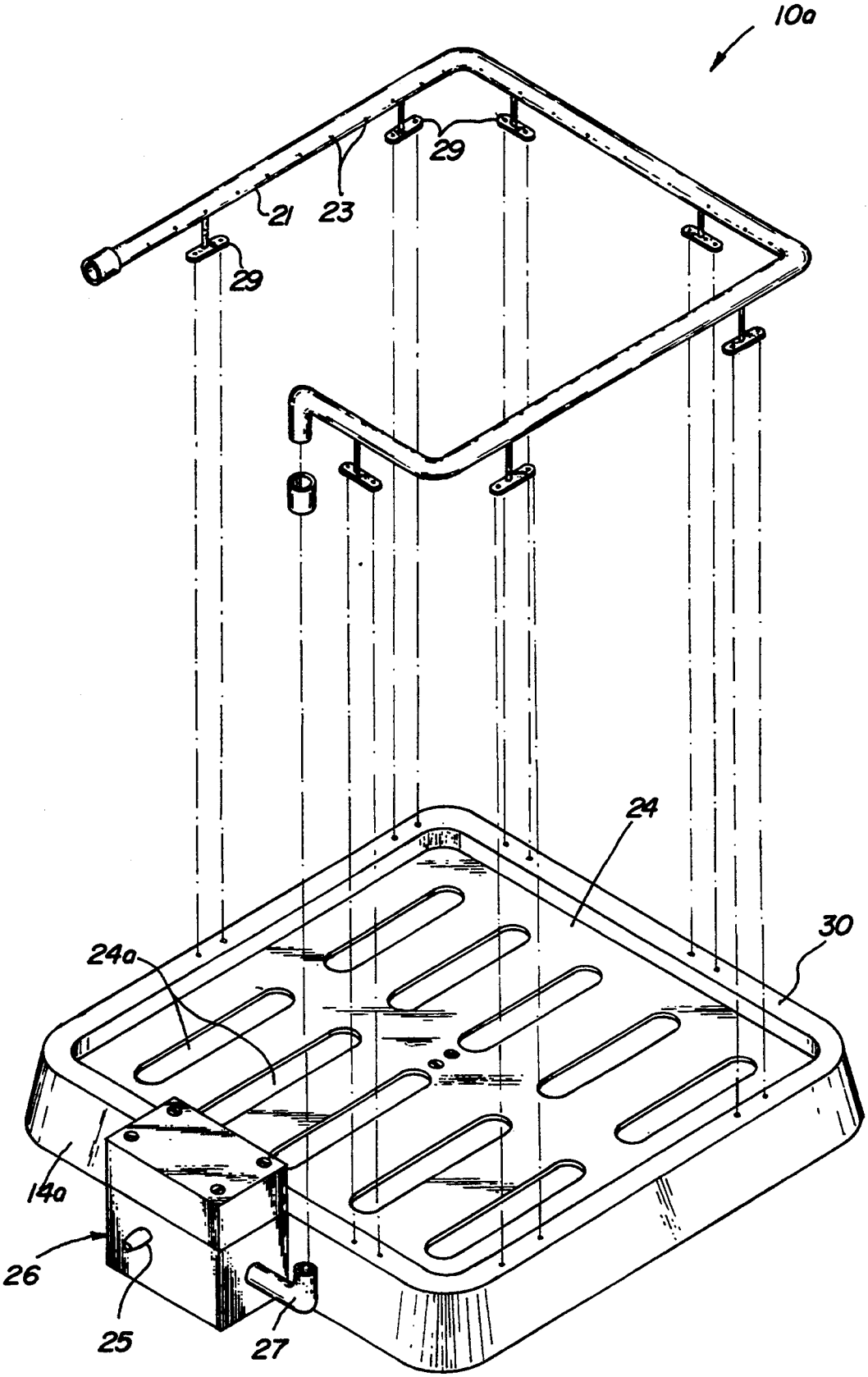
FIG. 5 is an isometric illustration of the water manifold arranged for mounting relative to the housing structure.

With reference now to the drawings, and in particular to FIGS. 1 to 12 thereof, a new and improved foot washer apparatus embodying the principles and concepts of the present invention and generally designated by the reference numerals 10 and 10*a* will be described.

More specifically, the foot washer apparatus 10 of the instant invention essentially comprises a container housing 11 to include a housing floor 12 formed with a respective first, second, third, and fourth side wall 13, 14, 15, and 16 respectively. The housing floor 12 is positioned above each lower distal end of each side wall to accommodate a drain conduit 18 below the housing floor 12 in fluid communication with the drain plate 19 directed through the floor. Drain channels 20 formed within the floor top surface direct water to the drain plate 19 and to the drain conduit 18. A conduit receiving opening 17 is directed through the second side wall 14 to receive a fluid conduit 21 therethrough, wherein the fluid conduit 21 defines a fluid manifold formed with apertures 23 directed through the fluid manifold configured as a conduit pipe, with the fluid manifold arranged in a circumferential relationship relative to the housing interior cavity 11*a* defined within the housing by the floor 12 and the side walls 13–16. Manual actuation of a conduit valve 22 permits fluid flow to the manifold and permitting water thereafter to be directed through the apertures 23 onto an individual's feet positioned within the housing cavity 11*a*.

Figure 6:
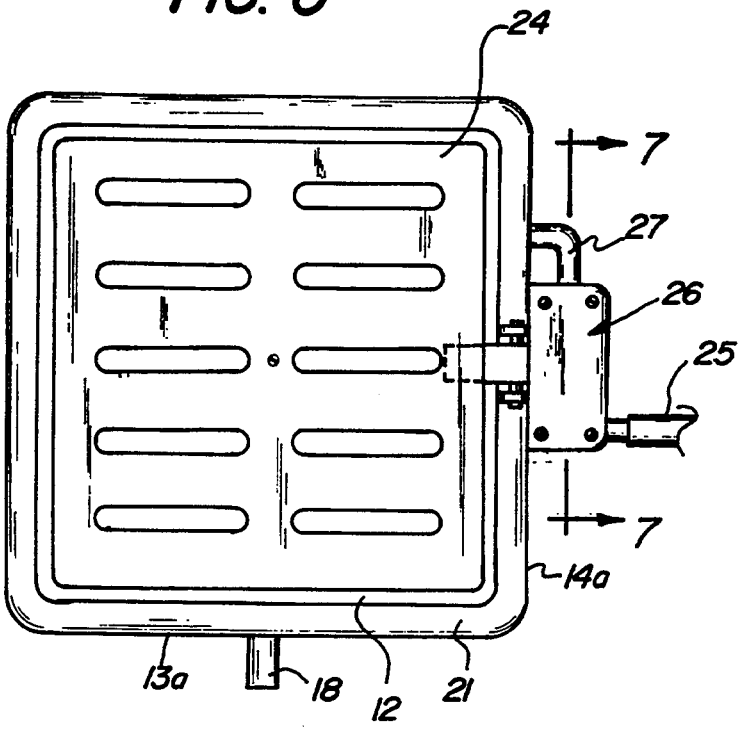
FIG. 6 is an orthographic top view of the manifold structure mounted to the housing.
Figure 7:
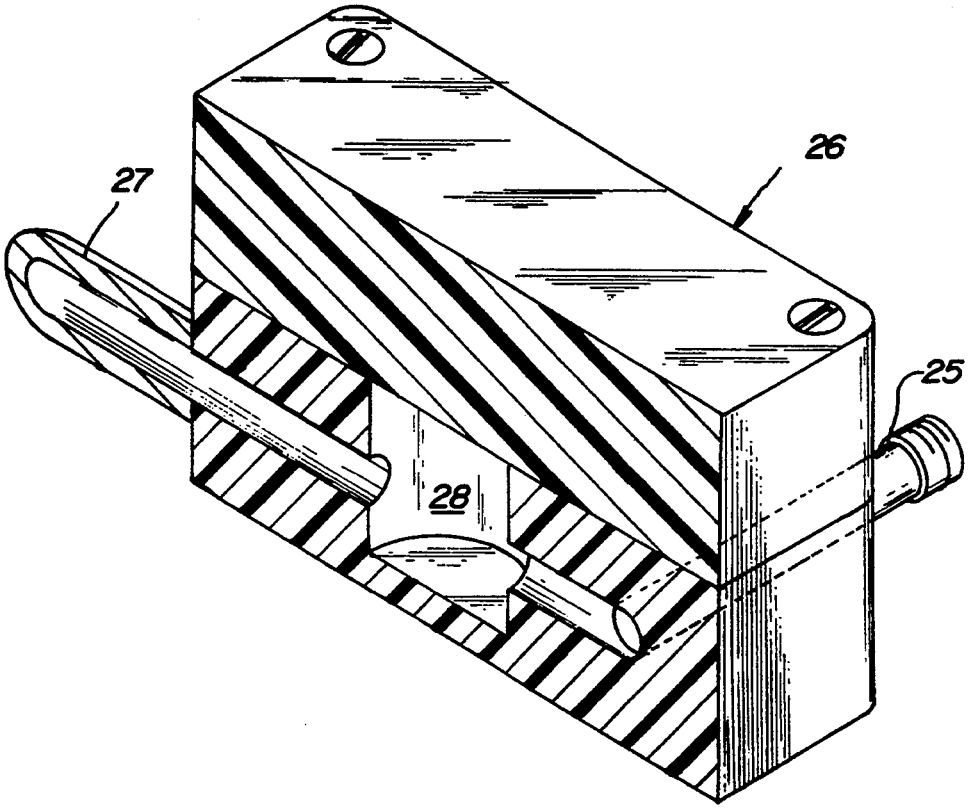
FIG. 7 is an orthographic view, taken along the lines 7—7 of FIG. 6 in the direction indicated by the arrows of the valve housing of the invention.
Figure 8:
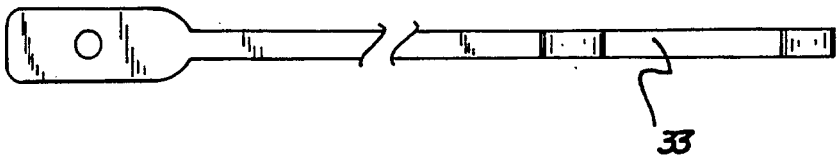
FIG. 8 is an orthographic top view of the actuator lever of the invention.
Figure 9:
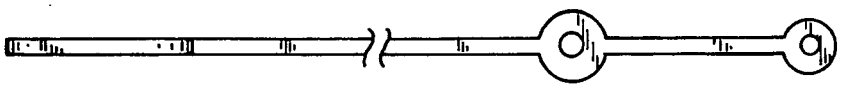
FIG. 9 is an orthographic side view of the actuator lever of the invention.
Figure 10:
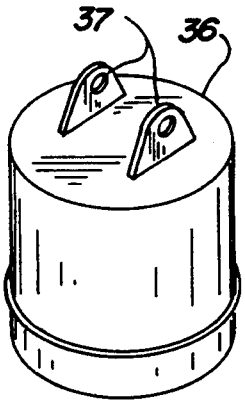
FIG. 10 is an isometric illustration of the piston utilized within the valve assembly of the invention.
Figure 11:
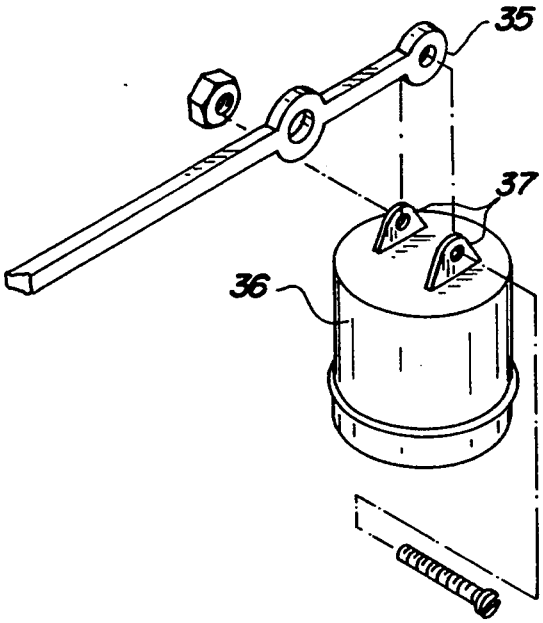
FIG. 11 is an isometric illustration of the actuator lever and piston structure in exploded view.
Figure 12:
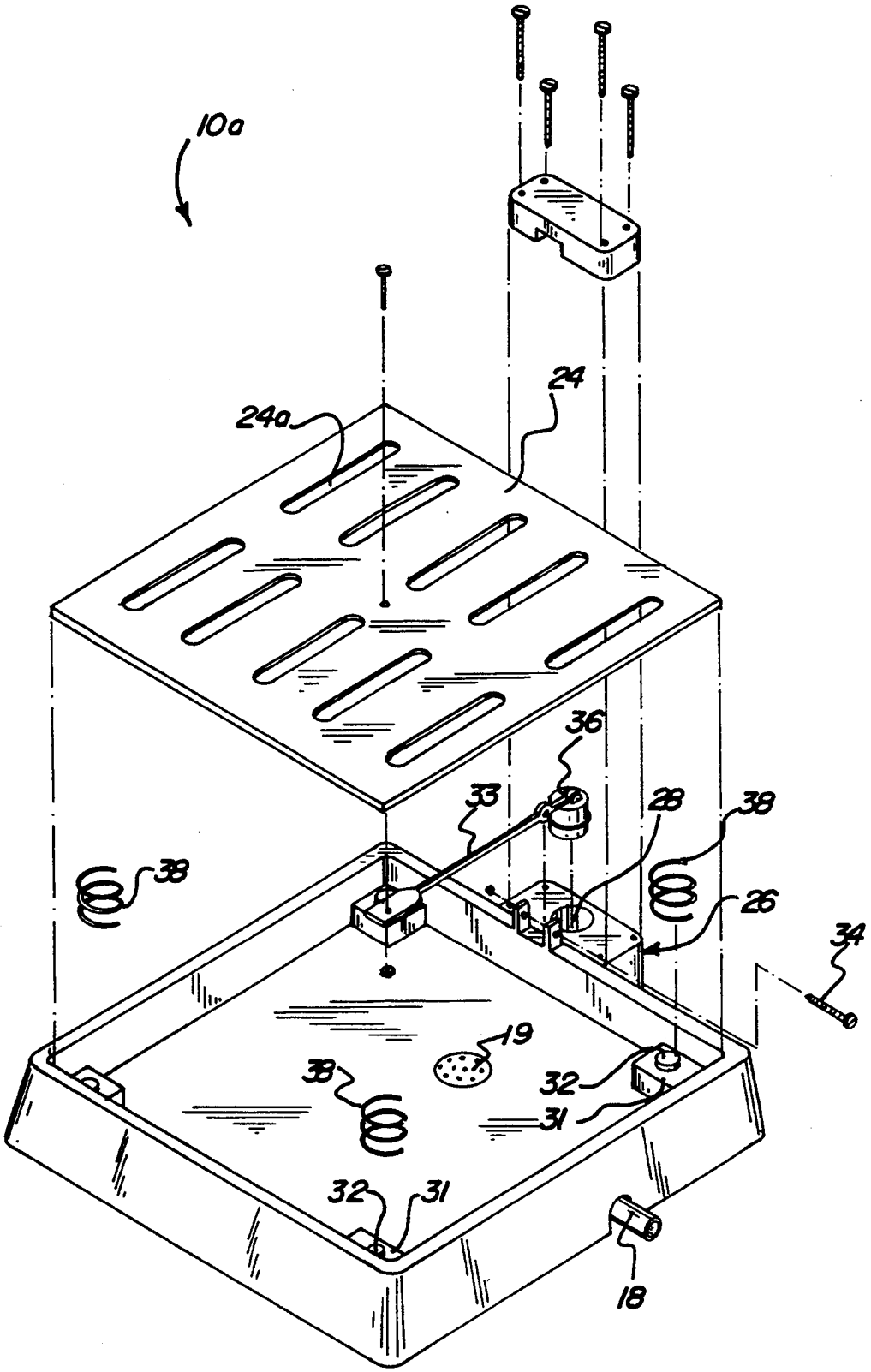
FIG. 12 is an isometric illustration of the modified housing structure illustrating the use of the actuator plate relative to the actuator lever structure utilized by the invention.

The FIGS. 2–12 illustrate the use of the housing to include an actuator plate 24 mounted within the housing cavity 11*a* in a parallel relationship relative to the housing floor 12. The actuator plate 24 includes a matrix drain slots 24*a* directed therethrough to permit access of fluid projected onto the actuator plate 24 to be directed subsequently to the drain plate 19. A valve assembly 26 is mounted to the second side wall 14*a* relative to the first side wall 13*a*, with the valve assembly conduit 27 directing fluid flow through the valve assembly 26 from a fluid delivery hose 25 directed into the valve assembly 26. The valve assembly conduit 27 is directed in fluid communication with the fluid conduit manifold 21. The valve assembly 26, as illustrated in FIGS. 7, includes a cylindrical valve chamber 28 positioned therewithin in fluid communication with the fluid delivery hose 25 and the valve assembly conduit 27. A piston 36 of a height equal to or less than one-half the predetermined height of the cylindrical valve chamber 28 is slidably mounted within the valve chamber 28, with the piston 36 including a plurality of piston flanges 37 mounted to a top surface of the piston 36 cooperative to receive an actuator lever rear pivot 35 of the actuator lever 33. An actuator lever pivot axle 34 between a forward distal end of the actuator lever 33 and the rear pivot 35 pivotally mounts the actuator lever 34 to the second side wall 14*a*, as illustrated in FIG. 6. The actuator lever 33 is positioned below the actuator plate 24 in use, with the actuator plate 24 biased upwardly to a first position by a plurality of spring members 38, with each spring member 38 mounted upon a spring position lug 32 that in turn is mounted to a planar top surface of a support web 31 that is spaced above the housing floor 12 (see FIG. 12). A plurality of support foot plates 29 (see FIG. 5) positions and secures the fluid conduit manifold 21 to the housing planar top wall surface 30, with the apertures 23 projecting interiorly of the housing towards the housing cavity 11*a*.

In this manner, an individual stepping upon an actuator plate 24 effects pivotment of the actuator lever 33 to effect lifting of the piston 36 above the intercommunication of the fluid delivery hose 25 into the valve chamber and the valve assembly conduit 27 from the valve chamber.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United Statyes is as follows:

1. A foot washer apparatus, comprising, a container housing, the container housing including a housing floor, with the housing floor including a first side wall, a second side wall, a third side wall, and a fourth side wall extending about the housing floor extending upwardly thereof to define a continuous perimeter about the housing floor, with the first side wall, second side wall, third side wall, and fourth side wall terminating in a planar top wall surface, with a drain plate directed through the housing floor, the drain plate in fluid communication with a drain conduit, the drain conduit directed through the first side wall, and a fluid conduit mounted to the housing, wherein the fluid conduit defines a fluid manifold, with the fluid conduit including a row of aligned fluid apertures directed through the fluid conduit, wherein the apertures are oriented above the planar top wall surface to project fluid interiorly of a housing interior cavity, wherein the housing interior cavity is oriented within the housing side walls and above the housing floor, and a valve assembly mounted to the housing second side wall, the valve assembly including a fluid delivery hose directed into the valve assembly, with the valve assembly including a cylindrical valve chamber within the valve assembly, with the fluid delivery hose directed into the valve chamber, and a valve conduit in fluid communication with the valve chamber directed from the valve chamber to the fluid manifold, and an actuator plate mounted movably above the housing floor, and an actuator lever pivotally mounted to the housing second side wall adjacent the valve assembly, with a forward distal end of the actuator lever positioned below the actuator plate and a rear distal end of the actuator lever positioned within the valve chamber, and a piston slidably mounted within the valve chamber, the piston including at least one flange mounted to a top surface of the piston, the at least one flange pivotally mounted to the rear distal end of the actuator lever, and a pivot axle positioned between the forward distal end of the actuator lever and the rear distal end of the actuator lever mounted to the second side wall, whereupon depressing of the actuator plate towards the housing floor effects displacement of the piston relative to the fluid delivery hose and the valve assembly conduit permitting fluid flow from the valve assembly conduit to the fluid delivery hose and to the fluid manifold.

2. An apparatus as set forth in claim 1 including a plurality of housing support webs fixedly mounted interiorly of the housing spaced above the housing floor, wherein each support web includes a positioning lug, and each positioning lug mounts a spring member about the positioning lugs, each said spring member extending from one of said support webs to support the actuator plate thereon to normally bias the actuator plate in a spaced relationship relative to each support web.

* * * * *